United States Patent [19]

Frigo

[11] 4,252,077

[45] Feb. 24, 1981

[54] PNEUMATIC SOUND GENERATOR

[75] Inventor: Domenico Frigo, Olmo, Italy

[73] Assignee: F.I.A.M.M. S.p.A. - Fabbrica Italiana Accumulatori Motocarri Montecchio, Montecchio Maggiore, Italy

[21] Appl. No.: 13,071

[22] Filed: Feb. 21, 1979

[30] Foreign Application Priority Data

Feb. 22, 1978 [IT] Italy ..... 30642/78[U]

[51] Int. Cl.[3] ..... B06B 1/18; B06B 1/20

[52] U.S. Cl. ..... 116/142 FP

[58] Field of Search ..... 116/142 FP, 142 FV, 116/142 R; 181/152, 159

[56] References Cited

U.S. PATENT DOCUMENTS 1,663,648 3/1928 Cooper ..... 116/142 FP 2,918,895 12/1959 Buell ..... 116/142 R

FOREIGN PATENT DOCUMENTS 2277394 1/1976 France ..... 116/142 FP

*Primary Examiner*—S. Clement Swisher

*Assistant Examiner*—Denis E. Corr

*Attorney, Agent, or Firm*—Karl F. Ross

[57] ABSTRACT

A pneumatic sound generator, such as an automobile horn, comprises a generally cup-shaped housing spanned by a membrane that rests against a central tubular boss forming a seat for the mouthpiece of a cornet through which air admitted into the housing via a lateral inlet escapes as the oscillating membrane is lifted off the boss. The cornet abuts an inner annular shoulder of the boss, together with a tubular insert which is either thermoplastic, received between the metallic cornet and housing, or metallic, seated within the mouthpiece of the thermoplastic cornet. In either case, the thermoplastic part—which preferably has a polygonal or corrugated inner cross-section—is tightly squeezed between two metallic members forcing an annular bead thereof into a surrounding groove of the inner periphery of the boss to form therewith an airtight seal.

7 Claims, 8 Drawing Figures

PNEUMATIC SOUND GENERATOR

FIELD OF THE INVENTION

My present invention relates to a pneumatic sound generator of the type used, for example, as a warning device for an automotive vehicle.

BACKGROUND OF THE INVENTION

Pneumatic sound generators usually comprise a housing with an inlet for air under pressure and a plenum chamber bounded by a membrane. The latter, when set in oscillation, intermittently opens an escape path to a resonator in the form of a horn or cornet whose tubular body has a mouthpiece secured to the housing and encloses a vibrating air column which determines the frequency of the emitted sound. Several such cornets may be used conjointly for multi-tone signaling.

The quality of the sound depends in large measure on the absence of leaks through which air could escape from the column. Thus, it is important to form an airtight junction between the housing and the mouthpice of the cornet. Though this mouthpiece could be an integral part of the housing which is threadedly or adhesively secured to the body of the cornet upon assembly, it is often more convenient to manufacture the housing separately. A threaded connection, in any event, is costly and also introduces an element of uncertainty since the pressure exerted during assembly determines the extent of interengagement and, with it, the calibration of the instrument. Such calibration can be carried out by other means, e.g. as disclosed in my prior U.S. Pat. No. 4,135,473, so that an invariable fit is desirable. The use of an adhesive, on the other hand, may leave unsightly deposits at the outer joint surface and/or a residue at the inside impairing the tonal quality. Moreover, the polymerization or setting time of the usual adhesives is rather long, thus delaying for a considerable period the use of a freshly assembled sound generator.

OBJECT OF THE INVENTION

The object of my present invention, accordingly, is to provide an improved joint between a housing and a cornet mouthpiece of a pneumatic sound generator of the character referred to.

SUMMARY OF THE INVENTION

The housing of a sound generator according to my invention is generally cup-shaped and has a wide open end spanned by a membrane secured to its rim, the opposite end of the housing being provided with a tubular boss which terminates substantially at the level of the rim so as to be normally in contact with the membrane. Air under pressure is admitted through an inlet into an annular plenum chamber defined by the membrane and the boss, this chamber being isolated in the quiescent condition from the interior of the boss which forms a passage open to the opposite housing end. The mouthpiece of a cornet is inserted from that opposite end into this passage to form a first tubular element inside the boss; a second such tubular element, in close contact with the first one, is constituted by an insert and is of a material different from that of the mouthpiece, i.e. thermoplastic if the mouthpiece is metallic and vice versa. In either case, the thermoplastic element is sandwiched between the metallic element and the boss (which may also be metallic) so as to be in firm contact with the latter. Preferably, an annular bead of the thermoplastic element is squeezed under pressure from the metallic element into an annular groove on the inner peripheral surface of the boss to form therewith an airtight seal.

The mouthpiece, whether metallic or thermoplastic, may be separately connected with the body of the cornet but, for the reasons stated above, is preferably integral therewith.

Advantageously, the boss has an inner peripheral shoulder which forms an annular seat for both tubular elements, i.e. for the mouthpiece and the insert, so as positively to define their positions relative to the housing.

According to another advantageous feature, the thermoplastic element—whether constituted by the mouthpiece or by the adjoining insert—has an inner peripheral surface which is of generally polygonal cross-section prior to assembly and is deformed into substantial circularity by its contact with the metallic element under the outward radial pressure exerted upon it by the latter.

BRIEF DESCRIPTION OF THE DRAWING

The above and other features of my invention will now be described in greater detail with reference to the accompanying drawing in which.

SPECIFIC DESCRIPTION

Figure 1:
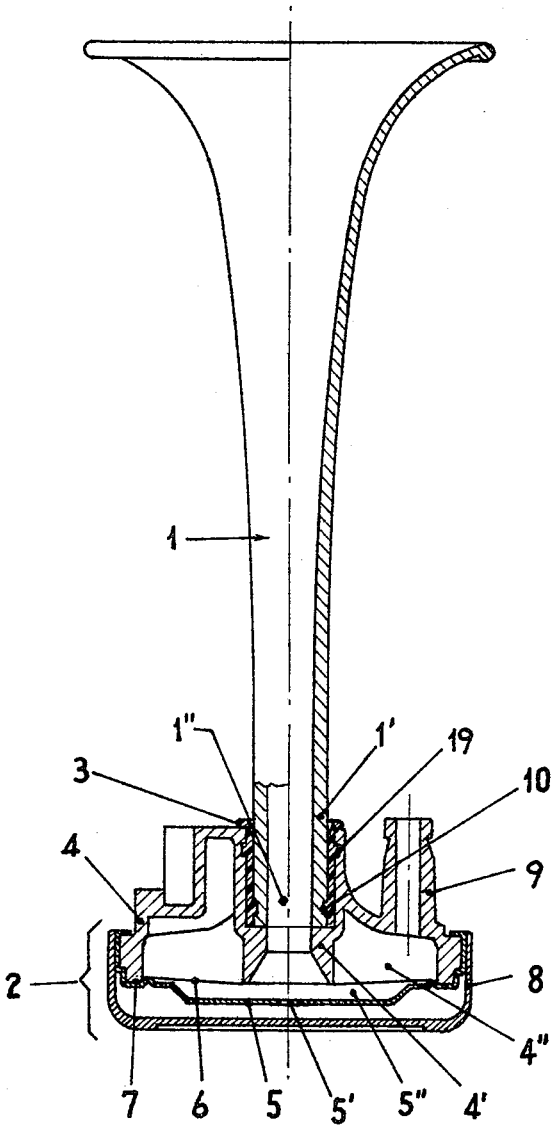
FIG. 1 is a side view, partly in axial section, of a pneumatic sound generator according to my invention.
Figure 2:
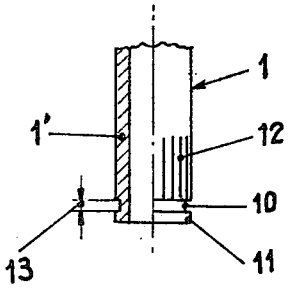
FIG. 2 is a part-sectional side view of a mouthpiece of a cornet forming part of the sound generator shown in FIG. 1.

In FIGS. 1–5 I have shown a sound generator for automotive vehicles comprising a horn or cornet 1 and a housing 4, both of metal. The housing, which is part of an enclosure 2, is cup-shaped and has a rim 7 which supports an elastic membrane 6, the membrane being held in position by a lid 5 overlain by a protective splash shield 8. Membrane 6 divides the interior of enclosure 2 into a plenum chamber 4'' and an air space 5'', the latter communicating with the atmosphere via a pressure-equalizing aperture 5' in lid 5 and nonillustrated passages in splash shield 8.

Centered on the housing axis is a tubular boss 4', integral with housing 4, which has an inner peripheral shoulder 22 (FIG. 5) forming a seat for a mouthpiece 1' of cornet 1, this mouthpiece being here simply an extremity of the stem of the cornet whose air channel 1'' is isolated from plenum chamber 4'' by the mouth of boss 4' when the membrane 6 is at rest. An inlet nipple 9 serves for the admission of air from a nonillustrated compressor into chamber 4''.

The inner diameter of boss 4' above shoulder 22 (as viewed in FIGS. 1 and 5) exceeds the outer diameter of cornet mouthpiece 1' so that an annular clearance is left therebetween. In accordance with my present invention, this clearance is occupied by a bushing 3 of thermoplastic material, such as polyamide or polypropylene, for example, whose volume substantially equals that of the clearance except for its end projecting beyond boss 4' which is shown provided with a peripheral flange 21 of mainly ornamental character. Bushing 3 is formed at its opposite end 16 with an inner annular bead 15 confronting, upon assembly, an annular groove 10 in mouthpiece 1'; an outer annular bead 14 near the flanged end of the bushing confronts an inner groove 19 of boss 4'. Bead 14 has an axial height 17 which before assembly (FIG. 3) slightly exceeds the height 20 of the corresponding groove 19; similarly, the height 17' of bead 15 slightly exceeds the height 13 of groove 10. Owing to the plastic deformability of bushing 3, however, its two beads enter the respective grooves and fully occupy them under pressure of the metallic mouthpiece 1' whose inner surface, upon coming to rest against shoulder 22, is flush with that of boss 4' whose mouth widens toward membrane 6. The interfitting of the beads and grooves creates an airtight seal between the cornet 1 and the housing 2.

Figure 3:
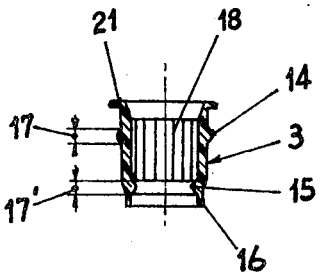
FIG. 3 is an axial sectional view of a thermoplastic insert included in that sound generator.
Figure 4:
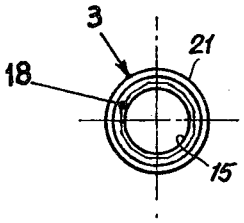
FIG. 4 is a top view of the insert shown in FIG. 3.
Figure 5:
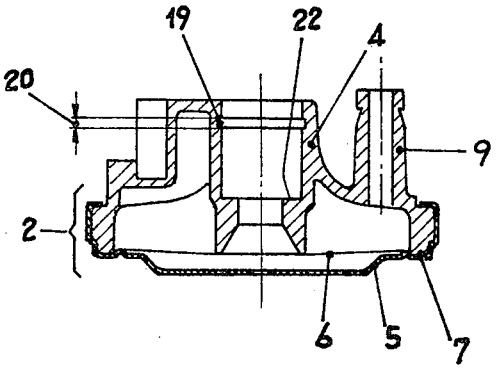
FIG. 5 is an axial sectional view of a housing forming part of the sound generator of FIG. 1.

Advantageously, at least the inner peripheral surface of bushing 3 is longitudinally ribbed or otherwise given a generally polygonal cross-section as indicated at 18 in FIGS. 3 and 4, with an apothem shorter than the outer radius of mouthpiece 1'. Upon assembly, this inner peripheral surface is outwardly deformed by the entering mouthpiece. As shown at 12 in FIG. 2, this mouthpiece may be externally ribbed or corrugated to prevent its rotation relative to bushing 3 and boss 4'. The bushing may be produced by compression molding.

Figure 6:
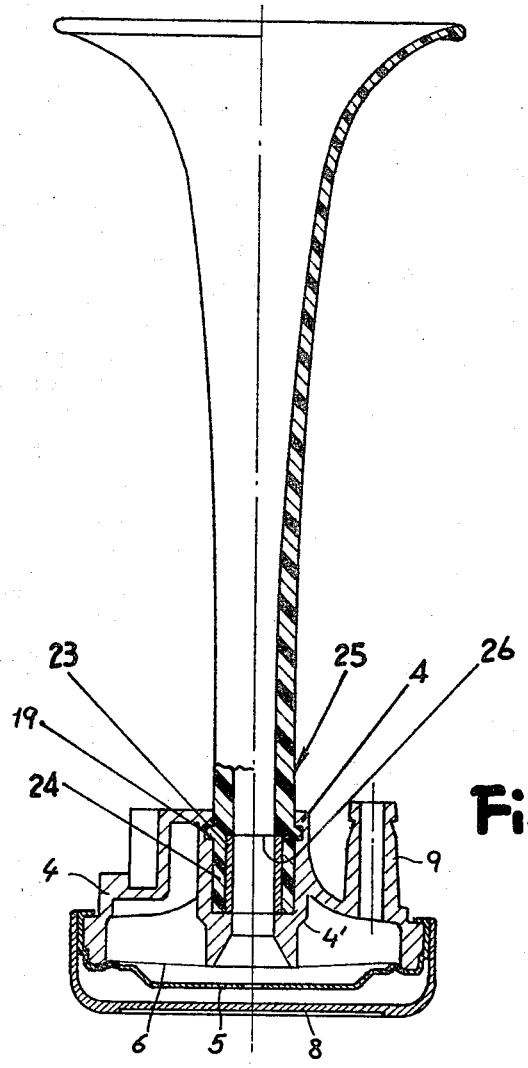
FIG. 6 is a view similar to FIG. 1, showing another embodiment of my invention.
Figure 8:
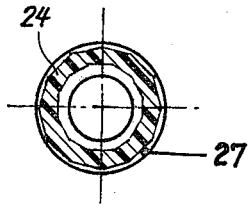
FIG. 8 is an end view of the mouthpiece shown in FIG. 7.
Figure 7:
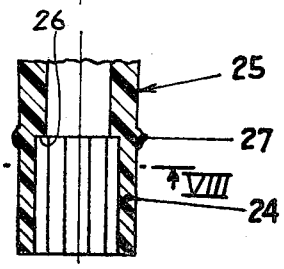
FIG. 7 is a part-sectional view of a mouthpiece of a cornet forming part of the sound generator of FIG. 6.

FIGS. 6, 7 and 8 show a modified cornet 25 of thermoplastic material with a mouthpiece 24 closely fitting into the boss 4' of housing 4. The mouthpiece has an inner peripheral recess 26 into which a metallic ferrule 23 is forcedly inserted so that its inner peripheral wall is flush with those of cornet 25 and boss 4'. Ferrule 23 terminates at a level about midway of groove 19 into which a bead 27 on the outer surface of mouthpiece 24 is firmly squeezed.

Here, again, the axial height of the bead advantageously exceeds that of the corresponding groove prior to assembly. Good results may also be achieved, however, with a smaller bead or even with an initially smooth outer surface of the mouthpiece if the latter is deformable by the inserted ferrule 23 into mating engagement with groove 19. For this purpose it is again desirable to provide the thermoplastic element—i.e. the mouthpiece 1'—on its inner and preferably also on its outer peripheral surface with a ribbed or polygonal cross-section in its recessed part, as seen in FIGS. 7 and 8.

As in the preceding embodiment, the two juxtaposed elements 23, 24 are jointly seated on the internal shoulder 22 (FIG. 5) of boss 4', preventing the escape of air under pressure from plenum chamber 4'' except by way of the channel of cornet 25 to an extent controlled by the vibrating membrane 6.

I claim:

1. A pneumatic sound generator comprising:

a generally cup-shaped housing provided with a wide open end bounded by a rim and with a tubular boss terminating substantially at the level of said rim, said boss forming a passage open to the opposite housing end;

a cornet having a mouthpiece inserted from said opposite end into said passage, said mouthpiece forming a first tubular element inside said boss;

an insert forming a second tubular element inside said boss in close contact with said first tubular element, one of said elements being metallic, the other of said elements being thermoplastic and being sandwiched between said metallic element and said boss, said thermoplastic element being squeezed under pressure from said metallic element into airtight contact with the inner peripheral surface of said boss, said thermoplastic element having an inner peripheral surface of generally polygonal cross-section deformed into substantial circularity by its contact with said metallic element;

a membrane secured to said rim and spanning said wide open end, said membrane being normally in contact with said boss to define with said housing an annular plenum chamber isolated from said passage; and inlet means on said housing for admitting air under pressure into said chamber, thereby oscillating said membrane and establishing intermittent communication between said chamber and said cornet.

2. A sound generator as defined in claim 1 wherein said insert constitutes said thermoplastic element and is sandwiched between said boss and said mouthpiece, said insert further having an inner annular bead engaging in an outer annular groove on said mouthpiece.

3. A sound generator as defined in claim 1 wherein said mouthpiece constitutes said thermoplastic element and is in direct contact with said boss, said insert being a ferrule received in an inner peripheral recess of said mouthpiece.

4. A pneumatic sound generator comprising:

a generally cup-shaped housing provided with a wide open end bounded by a rim and with a tubular boss terminating substantially at the level of said rim, said boss forming a passage open to the opposite housing end;

a cornet having a mouthpiece inserted from said opposite end into said passage, said mouthpiece forming a metallic tubular element inside said boss;

an insert forming a thermoplastic tubular element inside said boss sandwiched between said mouthpiece and said boss, said insert being squeezed under pressure from said mouthpiece into airtight contact with the inner peripheral surface of said boss and having an inner annular bead engaging in an outer annular groove of said mouthpiece;

a membrane secured to said rim and spanning said wide open end, said membrane being normally in contact with said boss to define with said housing an annular plenum chamber isolated from said passage; and inlet means on said housing for admitting air under pressure into said chamber, thereby oscillating said membrane and establishing intermittent communication between said chamber and said cornet.

5. A pneumatic sound generator comprising:

a generally cup-shaped housing provided with a wide open end bounded by a rim and with a tubular boss terminating substantially at the level of said rim, said boss forming a passage open to the opposite housing end;

a cornet having a mouthpiece inserted from said opposite end into said passage, said mouthpiece forming a thermoplastic tubular element in direct contact with said boss;

a ferrule forming a metallic tubular element received in an inner peripheral recess of said mouthpiece, the latter being squeezed under pressure from said ferrule into airtight contact with the inner peripheral surface of said boss;

a membrane secured to said rim and spanning said wide open end, said membrane being normally in contact with said boss to define with said housing an annular plenum chamber isolated from said passage; and inlet means on said housing for admitting air under pressure into said chamber, thereby oscillating said membrane and establishing intermittent communication between said chamber and said cornet.

6. A sound generator as defined in claim 1, 4 or 5 wherein said thermoplastic element is provided with an outer annular bead engaging in an annular groove on said inner peripheral surface.

7. A sound generator as defined in claim 1, 4 or wherein said boss has an inner peripheral shoulder forming an annular seat for both said elements.

* * * * *